US009492055B2

(12) United States Patent
Feddema

(10) Patent No.: US 9,492,055 B2
(45) Date of Patent: Nov. 15, 2016

(54) DISHWASHER WITH SPRAY SYSTEM

(75) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 842 days.

(21) Appl. No.: 13/570,511

(22) Filed: Aug. 9, 2012

(65) Prior Publication Data

US 2013/0074888 A1 Mar. 28, 2013

Related U.S. Application Data

(60) Provisional application No. 61/537,595, filed on Sep. 22, 2011.

(51) Int. Cl.

| | |
|---|---|
| ***A47L 15/22*** | (2006.01) |
| ***A47L 15/42*** | (2006.01) |
| ***A47L 15/23*** | (2006.01) |

(52) U.S. Cl.

CPC ..... *A47L 15/4282* (2013.01); *A47L 15/23* (2013.01)

(58) Field of Classification Search

CPC ... A47L 15/23; A47L 15/4282; A47L 15/16; A47L 15/4278

USPC ..... 134/172, 176, 179, 198

See application file for complete search history.

(56) References Cited

U.S. PATENT DOCUMENTS

| | | | | |
|---|---|---|---|---|
| 3,064,664 | A | | 11/1962 | Warhus |
| 3,064,665 | A | | 11/1962 | Martiniak |
| 3,146,953 | A | | 9/1964 | Komanns |
| 3,253,784 | A | * | 5/1966 | Long et al. ..... 239/101 |
| 3,709,236 | A | | 1/1973 | Field et al. |
| 3,771,725 | A | * | 11/1973 | Jenkins et al. ..... 239/243 |
| 3,797,509 | A | | 3/1974 | Fukuzawa et al. |
| 3,918,644 | A | | 11/1975 | Platt et al. |
| 4,266,565 | A | | 5/1981 | Gurubatham |
| 4,509,687 | A | | 4/1985 | Cushing |
| 4,993,444 | A | | 2/1991 | Toriyama et al. |
| 5,331,986 | A | | 7/1994 | Lim et al. |
| 5,415,350 | A | | 5/1995 | Yoon et al. |
| 5,427,129 | A | | 6/1995 | Young, Jr. et al. |
| 2,726,666 | A | | 12/1995 | Oxford |
| 5,546,968 | A | | 8/1996 | Jeon et al. |
| 5,577,665 | A | | 11/1996 | Chang |

(Continued)

FOREIGN PATENT DOCUMENTS

| | | |
|---|---|---|
| DE | 7024995 U | 6/1970 |
| DE | 4036930 A1 | 5/1992 |

(Continued)

OTHER PUBLICATIONS

European Search Report for Corresponding EP 12185512.6, Dec. 6, 2012.

(Continued)

*Primary Examiner* — Joseph L Perrin
*Assistant Examiner* — Irina Graf

(57) ABSTRACT

A dishwasher includes a tub at least partially defining a treating chamber and a spraying system for supplying liquid to the treating chamber. The spraying system includes a sprayer having a body with an interior, a liquid passage provided in the interior, and an outlet extending through the body and in fluid communication with the liquid passage. A fluid coupling defines a duration of a fluid communication between an opening of a valve body and the outlet.

17 Claims, 9 Drawing Sheets

(56) References Cited

U.S. PATENT DOCUMENTS

| | | | | |
|---|---|---|---|---|
| 5,601,100 | A | 2/1997 | Kawakami et al. | |
| 5,609,174 | A * | 3/1997 | Ferguson | 134/180 |
| 5,655,556 | A | 8/1997 | Guerrera et al. | |
| 5,662,744 | A | 9/1997 | Tuller et al. | |
| 5,673,714 | A | 10/1997 | Campagnolo et al. | |
| 5,697,392 | A | 12/1997 | Johnson et al. | |
| 5,944,037 | A | 8/1999 | Sinyong et al. | |
| 5,964,232 | A | 10/1999 | Chung | |
| 6,053,185 | A | 4/2000 | Beevers | |
| 6,325,083 | B1 | 12/2001 | Worter | |
| 7,314,188 | B2 | 1/2008 | Watson et al. | |
| 7,331,356 | B2 | 2/2008 | VanderRoest et al. | |
| 7,445,013 | B2 | 11/2008 | VanderRoest et al. | |
| 7,475,696 | B2 | 1/2009 | Vanderroest et al. | |
| 7,493,907 | B2 | 2/2009 | Roh | |
| 7,523,758 | B2 | 4/2009 | Vanderroest et al. | |
| 7,594,513 | B2 | 9/2009 | VanderRoest et al. | |
| 7,673,639 | B2 | 3/2010 | Shin | |
| 7,810,512 | B2 | 10/2010 | Pyo et al. | |
| 7,896,977 | B2 | 3/2011 | Gillum et al. | |
| 7,935,194 | B2 | 5/2011 | Rolek | |
| 7,959,744 | B2 | 6/2011 | Sundaram et al. | |
| 7,980,260 | B2 | 7/2011 | Bertsch et al. | |
| 8,113,222 | B2 | 2/2012 | Bertsch et al. | |
| 8,137,479 | B2 | 3/2012 | Vanderroest et al. | |
| 8,187,390 | B2 | 5/2012 | Vanderroest et al. | |
| 8,210,191 | B2 | 7/2012 | Gnadinger et al. | |
| 8,282,741 | B2 | 10/2012 | Bertsch et al. | |
| 2006/0108454 | A1 | 5/2006 | Eichholz | |
| 2006/0278258 | A1 | 12/2006 | Kara et al. | |
| 2007/0056613 | A1 | 3/2007 | Haas et al. | |
| 2007/0289615 | A1 | 12/2007 | Shin | |
| 2009/0101182 | A1 | 4/2009 | Buesing et al. | |
| 2009/0101185 | A1 | 4/2009 | Pardini | |
| 2009/0159103 | A1 | 6/2009 | Gillum et al. | |
| 2010/0108102 | A1* | 5/2010 | Kehl | A47L 15/4282 134/25.2 |
| 2010/0139719 | A1 | 6/2010 | Gnadinger et al. | |
| 2011/0030742 | A1 | 2/2011 | Dalsing et al. | |
| 2011/0203619 | A1 | 8/2011 | Kara et al. | |
| 2011/0303250 | A1 | 12/2011 | Delgado et al. | |
| 2012/0279530 | A1 | 11/2012 | Thiyagarajan | |
| 2012/0279536 | A1 | 11/2012 | Adams et al. | |
| 2013/0074886 | A1 | 3/2013 | Feddema et al. | |
| 2013/0074888 | A1 | 3/2013 | Feddema | |
| 2013/0074890 | A1 | 3/2013 | Feddema et al. | |
| 2014/0054395 | A1 | 2/2014 | Heisele et al. | |
| 2014/0332041 | A1 | 11/2014 | Feddema | |

FOREIGN PATENT DOCUMENTS

| | | | |
|---|---|---|---|
| DE | 102005026558 | B3 | 11/2006 |
| DE | 102010043019 | A1 | 5/2012 |
| DE | 102011053666 | A1 | 5/2012 |
| EP | 0524102 | A1 | 1/1993 |
| EP | 0764421 | B1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1252856 | A2 | 10/2002 |
| EP | 1277430 | A1 | 1/2003 |
| EP | 1334687 | B2 | 8/2003 |
| EP | 2292134 | A1 | 3/2011 |
| EP | 2572624 | A1 | 3/2013 |
| GB | 2019204 | A | 10/1979 |
| GB | 2199734 | A | 7/1988 |
| GB | 2215990 | A | 10/1989 |
| JP | 60053120 | | 3/1985 |
| JP | 4033632 | A | 2/1992 |
| JP | 5184514 | A | 7/1993 |
| JP | 8089467 | A | 4/1996 |
| JP | 9164107 | A | 6/1997 |
| JP | 10243910 | A | 9/1998 |
| JP | 11019019 | A | 1/1999 |
| JP | 11076127 | A | 3/1999 |
| JP | 2004113683 | A | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

German Search Report for Counterpart DE102013111241.2, May 23, 2014.

European Search Report for Corresponding EP 12185514.2, Dec. 6, 2012.

European Search Report for Corresponding EP 12185510.0, Dec. 19, 2012.

European Search Report for Corresponding EP14177086.7, Oct. 20, 2014.

European Search Report for Corresponding EP14155441.0, May 30, 2014.

European Search Report for Corresponding EP14155444.4, May 26, 2014.

* cited by examiner

DISHWASHER WITH SPRAY SYSTEM

CROSS-REFERENCE TO RELATED APPLICATIONS

This application claims of the benefit of U.S. Provisional Patent Application No. 61/537,595, filed Sep. 22, 2011, which is incorporated herein by reference in its entirety.

BACKGROUND OF THE INVENTION

Contemporary automatic dishwashers for use in a typical household include a tub and at least one rack or basket for supporting soiled utensils within the tub. A spraying system may be provided for recirculating liquid throughout the tub to remove soils from the utensils. The spraying system may include various sprayers including a rotatable spray arm.

SUMMARY

An embodiment of the invention relates to a dishwasher having a tub at least partially defining a treating chamber and a spraying system for supplying liquid to the treating chamber. The spraying system includes a rotatable spray arm having a body with an interior, a liquid passage provided in the interior, and a plurality of outlets extending through the body and in fluid communication with the liquid passage. The dishwasher also includes a valve body fluidly coupling the plurality of outlets to the liquid passage and moveable between at least two positions and an actuator operably coupled to the valve body and moving the valve body between the at least two positions based on the rotation of the rotatable spray arm.

DESCRIPTION OF EMBODIMENTS OF THE INVENTION

Figure 1:
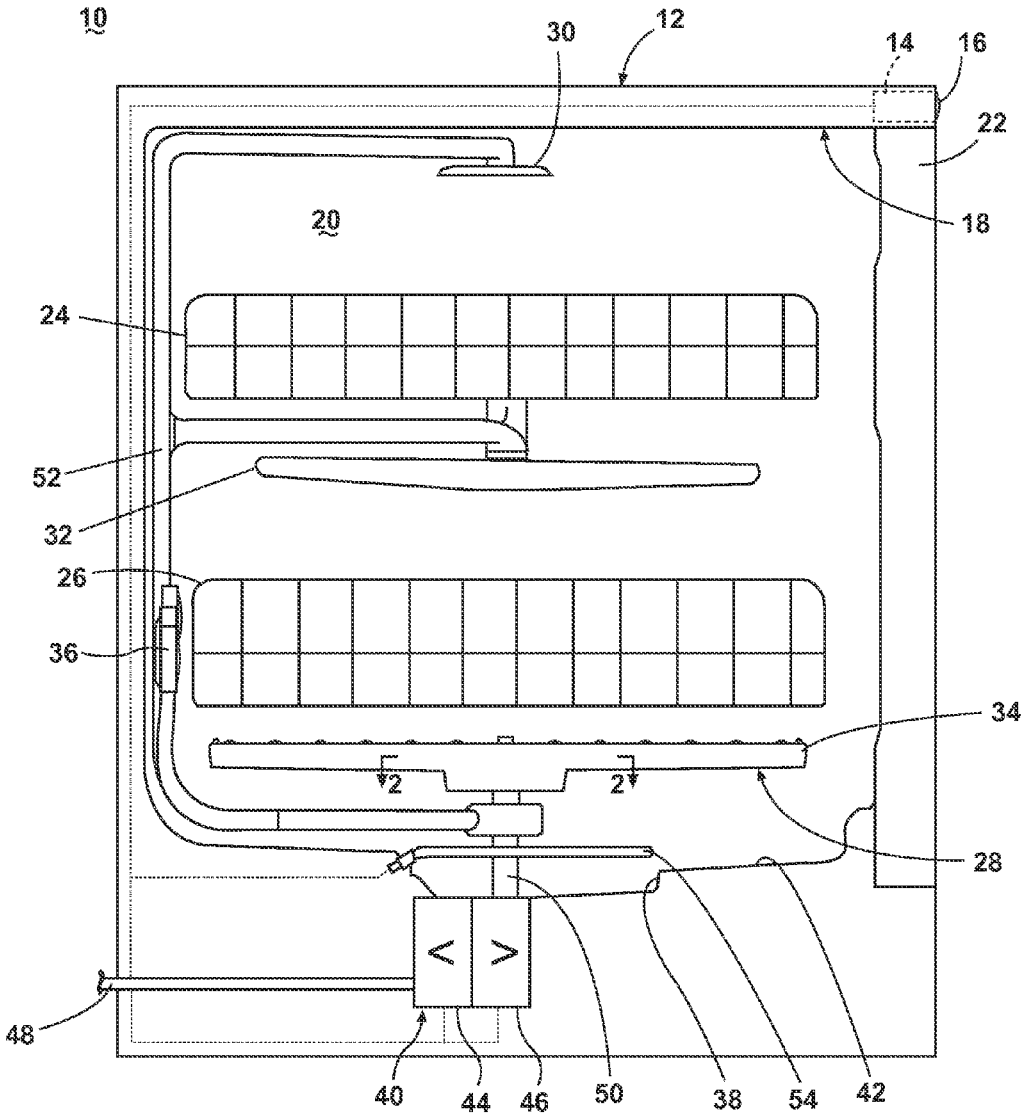
FIG. 1 is a schematic view of a dishwasher with a spray system according to a first embodiment of the invention.

Referring to FIG. 1, a first embodiment of the invention is illustrated as an automatic dishwasher 10 having a cabinet

12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any utensils positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
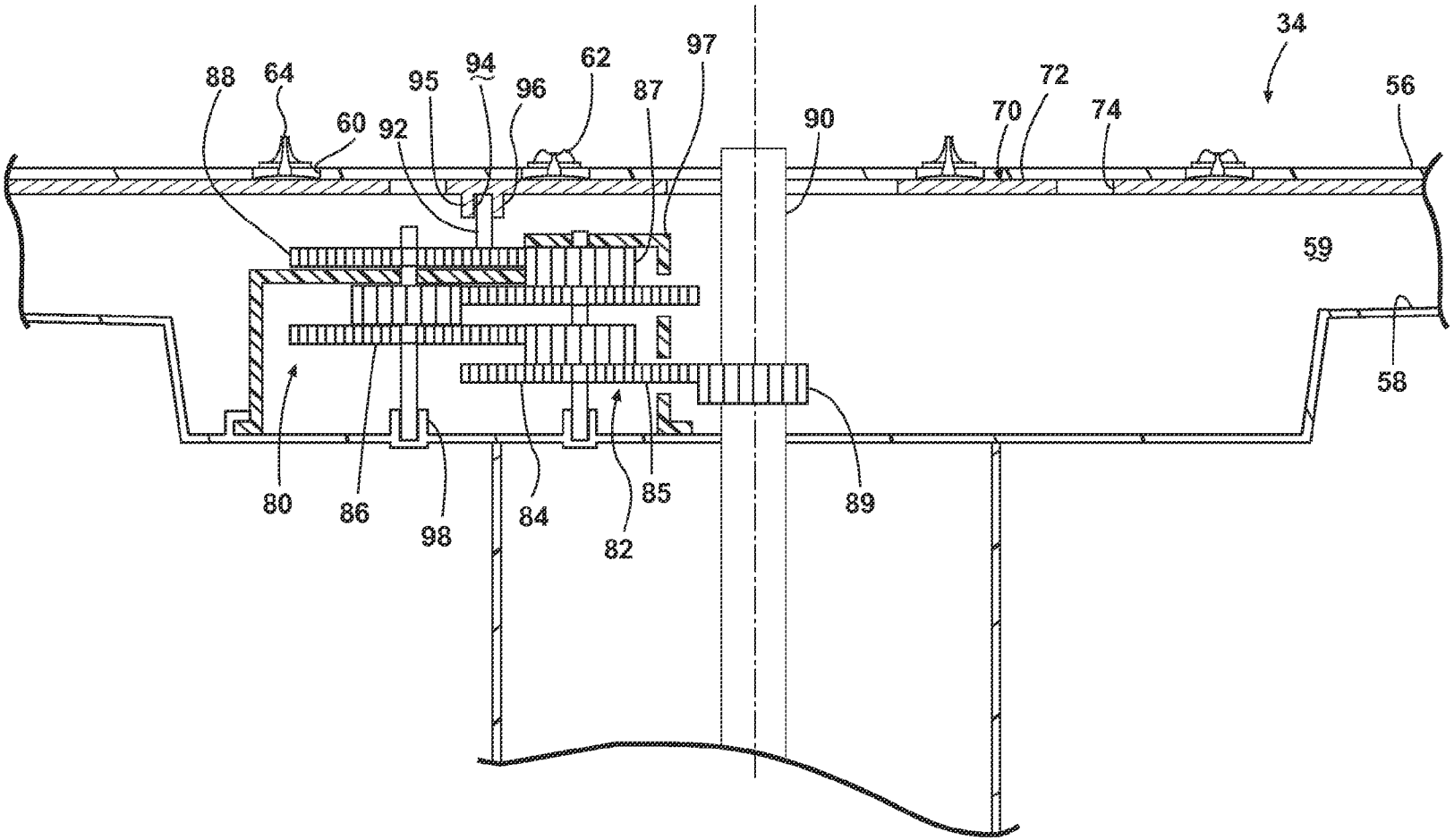
FIG. 2 is a cross-sectional view of a rotatable spray arm of the spray system of the dishwasher of FIG. 1 and illustrating a valve body for the rotatable spray arm.

FIG. 2 illustrates a cross-sectional view of the lower rotatable spray arm 34 comprising a body 56 having an interior 58. A liquid passage 59 may be provided in the interior 58 and fluidly couples with the outlet conduit 50 and recirculation pump 46. A plurality of outlets 60 extend through the body 56 and may be in fluid communication with the liquid passage 59. As illustrated, the interior 58 defines the liquid passage 59. However, a separate liquid passage 59 may be located within the interior 58.

Nozzles, such as nozzles 62 and 64, may be provided on the body 56 and may be fluidly coupled with the outlets 60, which lead to the liquid passage 59. Multiple nozzles 62 and 64 have been illustrated. The multiple nozzles 62 may correlate to a first subset of the plurality of outlets 60 and the multiple nozzles 64 may correlate to a second subset of the plurality of outlets 60. Nozzles 62 and 64 may provide different spray patterns, although this need not be the case. It is advantageous to do so to provide for different cleaning effects from a single spray arm. The first nozzle 62 may emit a first spray pattern (not shown), which may be a discrete, focused, and concentrated spray, which may provide a higher pressure spray. The second nozzle 64 may emit a second spray pattern (not shown), which may be a wide angle diffused spray pattern that produces more of a shower as compared to the more concentrated and discrete spray pattern produced by the first nozzle 62. The shower spray may be more suitable for distributing treating chemistry whereas the higher pressure spray may be more suitable for dislodging soils. It has been contemplated that the nozzles 62 and 64 may be arrange differently such that each type of nozzle 62, 64 may be included in both the first and second subsets of outlets 60.

A valve body 70 is illustrated as being located within the interior 56 and may be operable to selectively fluidly couple at least some of the plurality of outlets 60 to the liquid passage 59. The valve body 70 may be reciprocally moveable within the body 56. More specifically, the valve body 70 has been illustrated as including a slidable plate 72 having multiple openings 74. The slidable plate 72 may be slidably mounted within the interior 58 of the body 56 of the rotatable spray arm 34 for movement between at least two positions. One position may allow the multiple openings 74 to fluidly couple the first subset of outlets 60 to the liquid passage 59 and the second position may allow the multiple openings 74 to fluidly couple the second subset of outlets 60 to the liquid passage 59. In this way, the different nozzles 62, 64 and/or different spray patterns may be selected with the sliding of the plate 72. Alternatively, the different subsets of outlets 60 may be located on different portions of the arms such that the selection of a particular subset of outlets 60 controls the location of the spray, regardless of whether the spray pattern is different. For example, one subset of outlets 60 may be located at the ends of the spray arm to direct liquid solely into the hard to reach areas of the treating chamber.

An actuator 80 may be operably coupled with the valve body 70 and may move the valve body 70 between the at least two positions based on the rotation of the rotatable spray arm 34. The actuator 80 may be any suitable mechanism capable of moving the valve body 70 between the at least two positions based on the rotation of the rotatable spray arm 34. By way of a non-limiting example, the actuator 80 may include a drive system 82 operably coupled with the rotatable spray arm 34 and the valve body 70 such that rotation of the spray arm 34 moves the valve body 70 between the at least two positions. The drive system 82 has been illustrated as including a gear assembly 84 operably coupling the rotatable spray arm 34 and the valve body 70 such that rotation of the rotatable spray arm 34 moves the gear assembly 84 which in turn moves the slidable plate 72 between the at least two positions. Thus, the gear assembly 84 helps convert the rotational motion of the spray arm 34 into sliding motion for the slidable plate 72. The gear assembly 84 has been illustrated as including a gear chain having a first gear 85, second gear 86, third gear 87, fourth gear 88, and a fixed gear 89. A fixed shaft 90 may extend through a portion of the body 56 such that the rotatable spray arm 34 is rotationally mounted on the fixed shaft 90. Further, the fixed gear 89 may be fixedly mounted on the fixed shaft 90.

The drive system 82 further comprises a pin 92 operably coupled with and extending from an upper portion of the fourth gear 88 and received within a channel 94 located in the valve body 70 to operably couple the gear assembly 84 with the slidable plate 72. The channel 94 may be a depression in a bottom portion of the slidable plate 72 or as illustrated may be formed between two opposing walls 95, 96 extending downwardly from the bottom of the slidable plate 72.

A bracket 97 may be located within the interior 58 and houses at least a portion of the gear assembly 84 to provide support for the gear assembly 84. Portions of the gear assembly 84 may also be held within supports 98 formed by the body 56 of the spray arm assembly 34.

The operation of the dishwasher 10 with the described spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

Figure 3A:
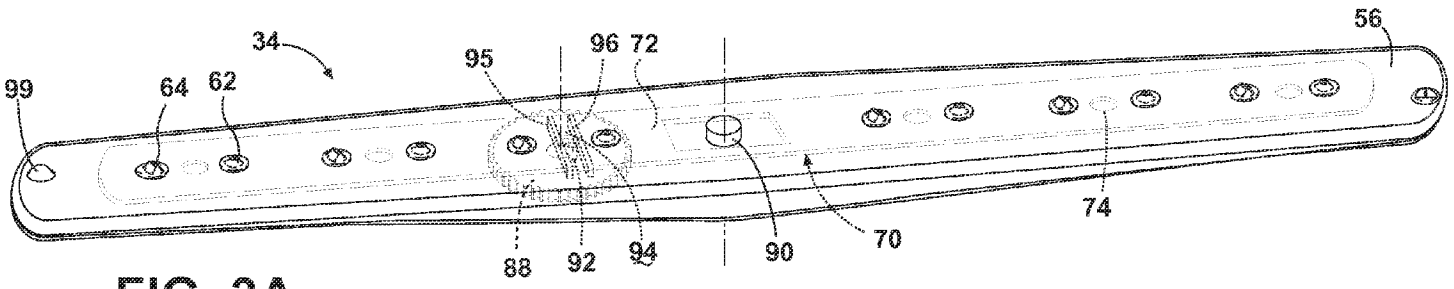
FIGS. 3A-3C are schematic views of the valve body in various positions within the rotatable spray arm of FIG. 2.

The lower rotatable spray arm 34 may rely on liquid pumped from the recirculation pump 46 to provide hydraulic drive to rotate the lower rotatable spray arm 34, which through the actuator 80 affects the movement of the valve body 70. More specifically, as illustrated in FIG. 3A, a hydraulic drive 99 may be formed by an outlet in the body 56 being oriented such that liquid emitted from the hydraulic drive outlet 99 effects the rotation of the lower rotatable spray arm 34. The lower rotatable spray arm 34 has been illustrated as having two hydraulic drive outlets 99 and these hydraulic drive outlets 99 are located such that when the recirculation pump 46 is activated, the lower rotatable spray arm 34 rotates regardless of the position of the valve body 70. It has also been contemplated that such hydraulic drive outlets 99 may be located on various portions of the body 56 including a side or bottom portion of the body 56. Alternatively, one or more of the multiple nozzles 62, 64 may form such hydraulic drive outlets.

As the lower rotatable spray arm 34 is hydraulically rotated about the fixed shaft 90, the first gear 85, which is mounted between the fixed gear 89 and the second gear 86, which is rotatably mounted within the support 98 moves with the rotation of the lower rotatable spray arm 34 and may be driven around the fixed gear 89. Thus, the first gear 85 is also hydraulically driven and may be caused to circle about the fixed gear 89 as the lower rotatable spray arm 34 rotates about the fixed shaft 90. As the first gear 85 is driven about the fixed gear 89, it in turn causes the rotation of the second gear 86, the third gear 87, and the fourth gear 88.

Figure 3B:
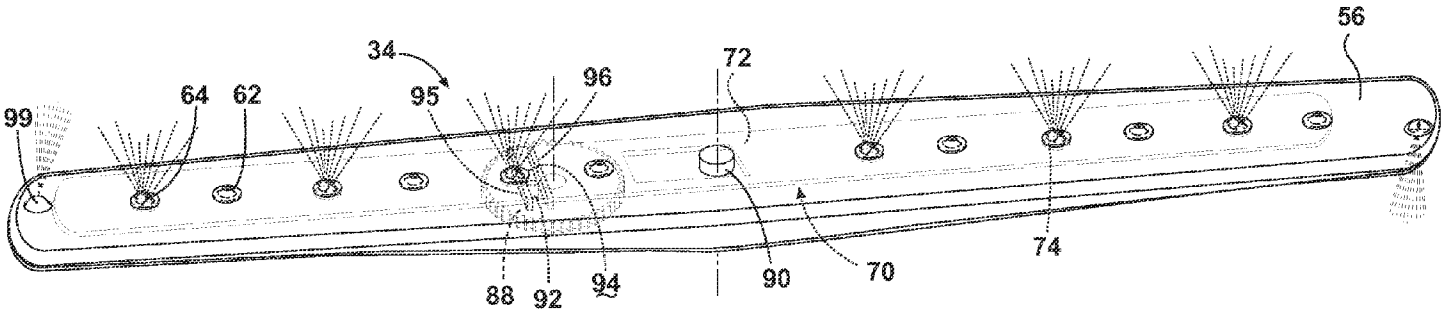
Figure 3C:
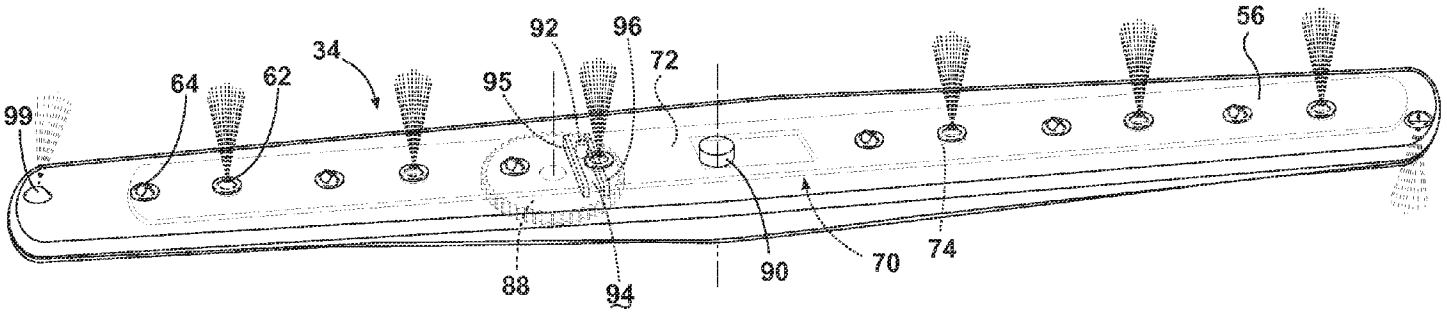

As the fourth gear 88 rotates, the pin 92 rotates within the interior 58 of the lower rotatable spray arm 34. As the pin 92 rotates, it moves within the boundaries of the channel 94 and causes the slidable plate 72 to be moved back and forth within the interior 58 of the lower rotatable spray arm 34. More specifically, as the pin 92 rotates with the fourth gear 88, the pin 92 pushes on the wall 95 for a first portion of a full rotation of the fourth gear 88 and pushes on the wall 96 for a second portion of the full rotation of the fourth gear 88. When the pin 92 pushes on the wall 95 it moves the slidable plate 72 to the first position illustrated in FIG. 3B. The slidable plate 72 may stay in the first position until the pin 92 is rotationally advanced to a point where it begins to push on the wall 96. When the pin 92 pushes on the wall 96 it moves the slidable plate 72 in the opposite direction until it reaches the second position illustrated in FIG. 3C. The slidable plate 72 may stay in the second position until the pin 92 is rotationally advanced to a point where it begins to again push on the wall 95. As the fourth gear 88 continues to rotate, the pin 92 continues to alternatively push against one of the walls 95 and 96 and continues to move the slidable plate 72 into the first and second positions. In this manner, the movement of the pin 92 within the channel 94 operably couples the gear assembly 84 to the slidable plate 72 such that the rotation of the gear assembly 84 may be converted into translational movement of the slidable plate 72. Essentially, the actuator 80 allows the valve body 70 to move between the at least two positions based on a rotational position of the rotatable spray arm 34.

As the slidable plate 72 moves side to side inside the lower rotatable spray arm 34, the valve body 70 closes the fluid path to one of the first and second subsets of outlets 60 and opens a fluid path to the other of the first and second subsets of outlets 60. More specifically, as the slidable plate 72 moves within the lower rotatable spray arm 34, the multiple openings 74 may align with either the first and second subset of outlets 60. When the slidable plate 72 is in the first position, the multiple openings 74 are aligned with the first subset of outlets 60 correlating to the multiple nozzles 62 and in the second position the multiple openings 74 are aligned with the second subset of outlets 60 correlating to the multiple nozzles 64. Thus, as the valve body 70 moves relative to the lower rotatable spray arm 34, each of the first and second subsets of outlets 60 are sequentially fluidly coupled and uncoupled as the lower rotatable spray arm 34 rotates.

It has been contemplated that the valve body 70 may have additional openings or alternative openings such that the second subset of the plurality of outlets which are fluidly coupled with the liquid passage may only differ from the first subset by one of the outlets. It has also been contemplated that when the valve body 70 is located intermediately of the first and second positions, water may be still be sprayed from the plurality of outlets 60 if at least a portion of the multiple openings fluidly couples a portion of the plurality of outlets 60. It has also been contemplated that the valve body 70 may be shaped such that there may be a point where the outlets in the valve body 70 do not allow for the fluid to enter any of the plurality of outlets 60 except for the hydraulic drive outlets 99.

The gear chain of the gear assembly 84 is illustrated as forming a reduction gear assembly. That is the valve body 70 is moved between the at least two positions by the actuator 80 over multiple rotations of the lower rotatable spray arm 34. As illustrated, the reduction gear assembly may provide a 40:1 gear reduction such that the valve body 70 will slide to the first and second positions over forty revolutions of the lower rotatable spray arm 34. The gear ratios of the gear assembly 84 may be selected to control the relative movement of the valve body 70 to the lower rotatable spray arm 34. The gear ratio of the gear assembly 84 is a function of the ratios of gears forming the gear assembly 84. Thus, the gears may be selected to provide a desired ratio to provide a desired fluid coupling time between the fluid passage 59 and the first and second subsets of outlets 60. The gear reduction ratio may also be selected to aid in allowing the hydraulic drive outlets 99 to overcome the friction created by the valve body 70.

As the rotatable spray arm 34 turns, the valve body 70 continues to move between the first and second positions and continues to selectively fluidly couple the first and second subsets of outlets 60. The amount of time that the multiple openings 74 are fluidly coupled with each of the first and second subsets of outlets 60 controls the duration of the time that each of the nozzles 62, 64 spray liquid. The time of fluid coupling may be thought of as a dwell time. With the above described valve body 70 and actuator 80, the dwell time may be controlled by the gear ratio and the flow rate of liquid. The movement of the lower rotatable spray arm 34 and the valve body 70 ends when fluid is no longer pumped by the recirculation pump 46 to the lower rotatable spray arm 34 such that the lower rotatable spray arm 34 is no longer hydraulically driven.

It has also been contemplated that a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. Such a motor-driven spray arm is set forth in detail in U.S. patent application Ser. No. 12/336,033, filed Dec. 16, 2008, and titled "Dishwasher with Driven Spray Arm for Upper Rack" and U.S. patent application Ser. No. 12/761,438, filed Apr. 16, 2010, and titled "Dishwasher with Driven Rotatable Spray Arm," which are incorporated herein by reference in their entirety. If the lower rotatable spray arm 34 is motor operated, the valve body 70 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the multiple nozzles 62 and 64 in pre-selected areas of the treating chamber 20.

Figure 4:
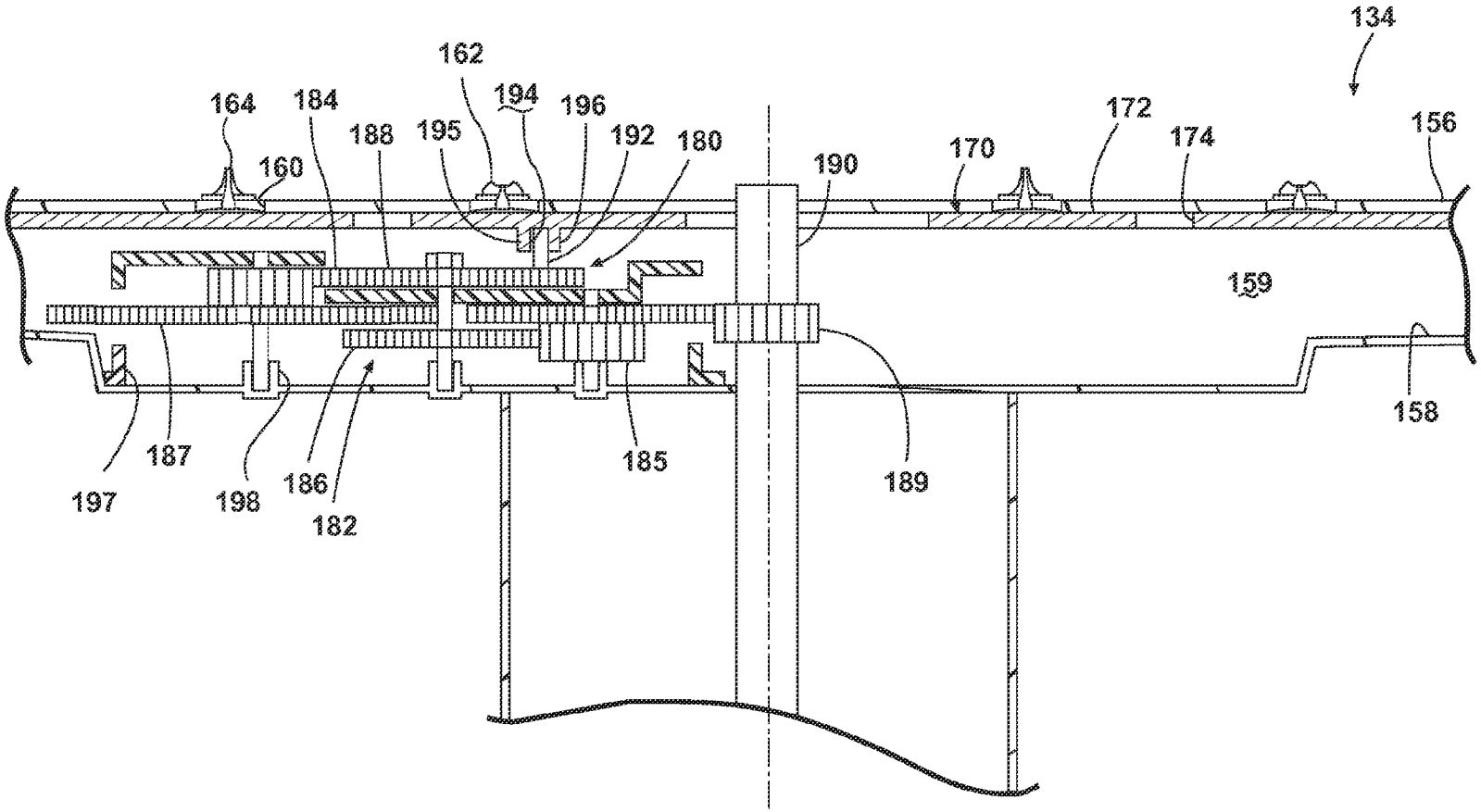
FIG. 4 is a cross-sectional view of a second embodiment of a lower spray arm, which may be used in the dishwasher of FIG. 1.

FIG. 4 illustrates a cross-sectional view of an alternative lower rotatable spray arm 134 according to a second embodiment of the invention. The lower rotatable spray arm 134 is similar to the lower rotatable spray arm 34 previously described and therefore, like parts will be identified with like numerals increased by 100, with it being understood that the description of the like parts of the lower rotatable spray arm 34 applies to the lower rotatable spray arm 134, unless otherwise noted.

The differences between the lower rotatable spray arm 34 and the lower rotatable spray arm 134 include that the lower rotatable spray arm 134 has been illustrated as having a lower profile body 156, an alternative gear assembly 184, and an alternative bracket 197, which is configured to accommodate the alternative gear assembly 184. During operation, the lower rotatable spray arm 134, valve body 170, and actuator 180 operate much the same as in the first embodiment wherein as the lower rotatable spray arm 134 is rotated, the gears in the gear assembly 184 are driven and the slidable plate 172 is moved between the first and second positions. However, the gear assembly 184 is configured to provide a larger gear reduction, namely a 73:1 gear reduction, such that the valve body 170 will slide to the first and second positions over 73 revolutions of the lower rotatable spray arm 134. Thus, the dwell time or fluid coupling time between the fluid passage 159 and the first and second subsets of outlets 160 is greater than in the first embodiment. Further, the lower profile body 156 may increase the space available in the treating chamber 20 for holding utensils to be treated.

Figure 5:
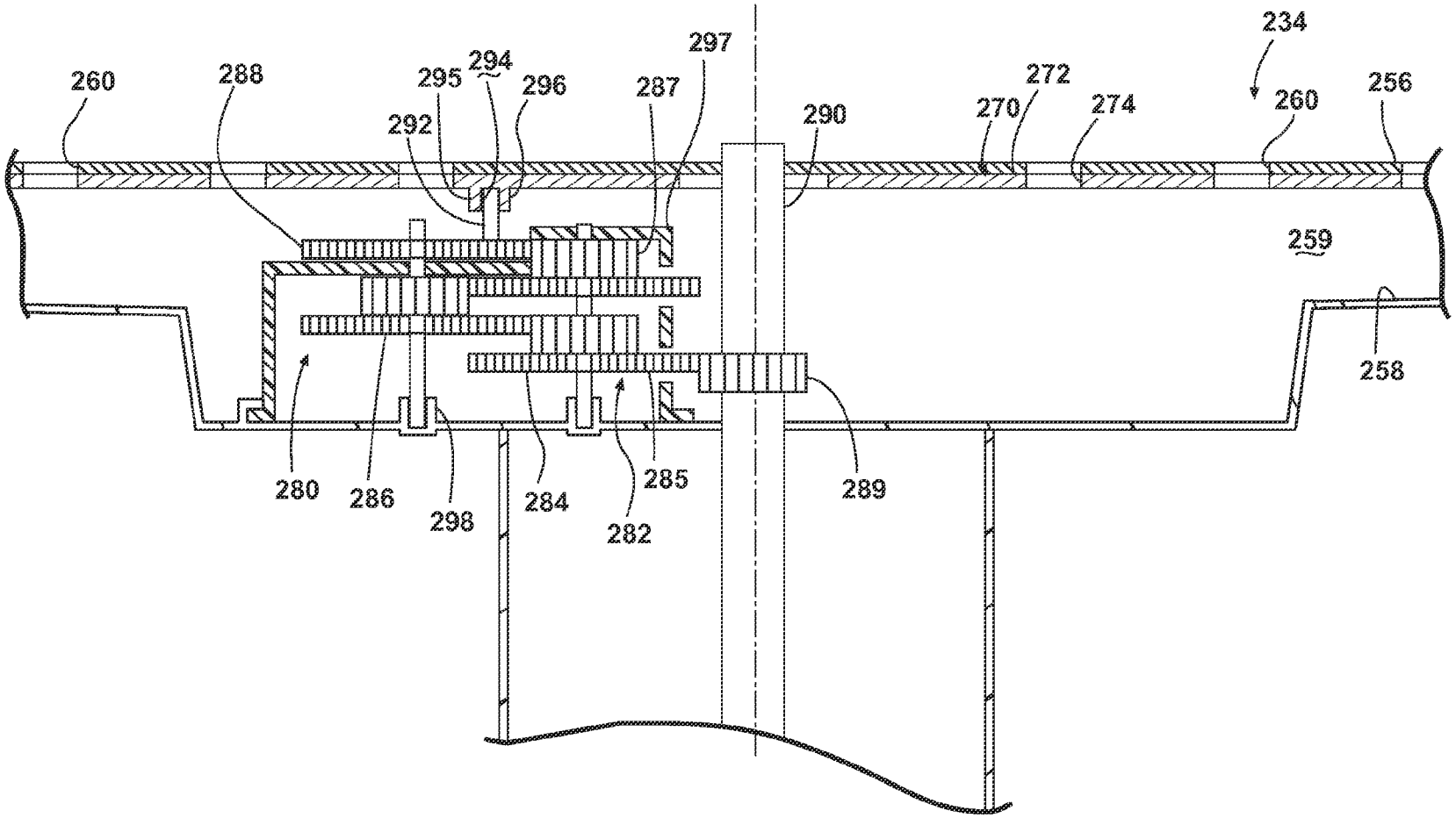
FIG. 5 is a cross-sectional view of a third embodiment of a lower spray arm, which may be used in the dishwasher of FIG. 1.

FIG. 5 illustrates a cross-sectional view of an alternative lower rotatable spray arm 234 according to a third embodiment of the invention. The lower rotatable spray arm 234 is similar to the lower rotatable spray arm 34 previously described and therefore, like parts will be identified with like numerals increased by 200, with it being understood that the description of the like parts of the lower rotatable spray arm 34 applies to the lower rotatable spray arm 234, unless otherwise noted.

One difference between the lower rotatable spray arm 34 and the lower rotatable spray arm 234 is that the plurality of outlets 260 form the nozzles for the spray arm 234 and no additional nozzle structures are provided on the body 256. Further, each of the outlets 260 is illustrated as having an identical configuration, such that there are no first and second subsets of outlets 260 as in the first embodiment. Alternatively, however, the outlets 260 can be configured to provide different spray patterns, similar to the first embodiment. Another difference is that the slidable plate 272 of the valve body 270 has the same number of openings 274 as there are nozzle outlets 260. The slidable plate 272 may be slidably mounted within the interior 258 of the rotatable spray arm 234 for movement between at least two positions, and both positions may result in the multiple openings 274 being fluidly coupled with the multiple outlets 260. The valve body 270 may be formed such that the multiple openings 274 only partially close off a portion the outlet 260 as the slidable plate 272 is moved between the first and second positions. In this manner, each paired outlet 260 and opening 274 may collectively form an effective opening or nozzle, and the slidable plate 272 may move to adjust the relative positions of the outlets 260 and opening 274 to alter the shape of the effective nozzle to control the shape of the spray and direction of liquid emitted from the outlet 260.

Figure 6A:
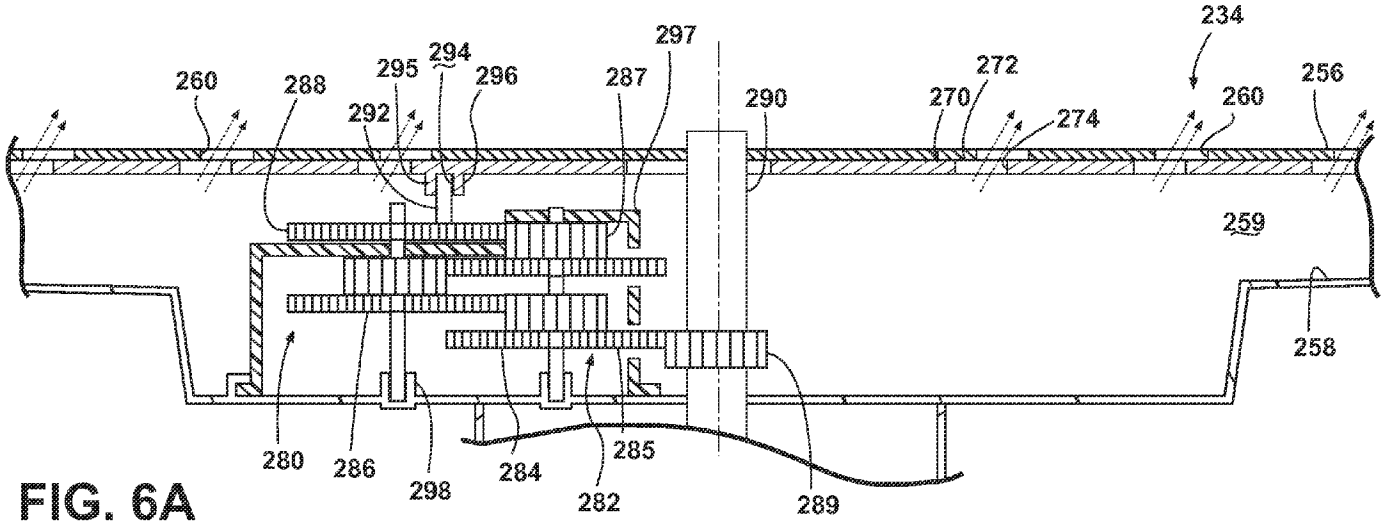
FIGS. 6A-6B are cross-sectional views of a valve body in various positions within the rotatable spray arm of FIG. 5.
Figure 6B:
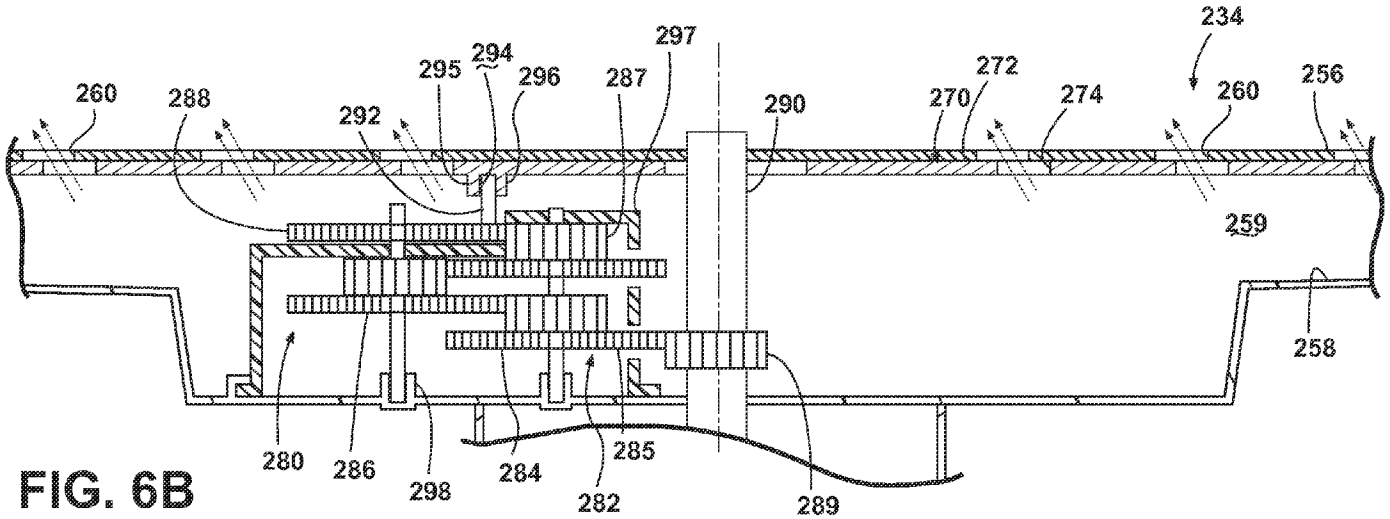

FIG. 6A illustrates a spray pattern that may be created when the slidable plate 272 is in the first position and FIG. 6B illustrates a spray pattern that may be created when the slidable plate 272 is in the second position. During operation, the lower rotatable spray arm 234, valve body 270, and actuator 280 operate much the same as in the first embodiment wherein as the lower rotatable spray arm 234 is rotated, the gears in the gear assembly 284 are driven and the slidable plate 272 is moved between the first and second positions. Alternatively, the rotatable spray arm 234 can be provided with a gear assembly similar to that of the second embodiment to achieve a higher gear reduction and longer dwell time.

As the slidable plate 272 is moved, the spray pattern from the outlets 260 is altered by the translation of the openings 274, which acts to change the flow of liquid from the outlet 260 by both reducing the size and changing the shape of the effective nozzle formed by the outlet 260 and opening 274. One result is that the direction of the liquid spraying from the outlets 260 is varied with the movement of the slidable plate 272. When the plate 272 is in the first position as shown in FIG. 6A, liquid may be sprayed out of the outlets 260 in a first direction generally toward one distal end of the spray arm 234 for a fixed number of revolutions. Likewise, when the plate 272 is in the second position as shown in FIG. 6B, liquid may be sprayed out of the outlets 260 in a second direction, different than the first direction, generally toward the other distal end of the spray arm 234 for a fixed number of revolutions. Depending on the configuration of the outlets 260 and openings 274, the first and second directions may be separated by an arc ranging between and 45° and 120°. Furthermore, while not illustrated herein, as the plate 272 transitions between the first and second positions, liquid may be sprayed out of the outlets 260 in at least one, and possibly many, intermediate direction, generally upward from the spray arm 234 for a fixed number of revolutions. The actual time or amount of revolutions that the liquid is sprayed in each direction may be altered based on the design of the lower rotatable spray arm 234, valve body 270, spacing between the walls 295, 296, pin location 292, slot length 274, and gear assembly 284.

The force and shape of the pattern of the sprays emitted from the outlets 260 may also change with movement of the slidable plate 272. As the openings 274 come into alignment with the outlets 260, the effective nozzle becomes wider, and a more diffused, wide-angle spray pattern may be emitted from the effective nozzle that produces a shower spray of liquid from the spray arm 234. Conversely, as the outlets 260 are overlapped with the solid plate portion of the slidable plate 272, the effective nozzle becomes smaller, and a more discrete, focused, and concentrated the spray pattern may be emitted from the effective nozzle, which may provide a higher pressure spray from the spray arm 234. The shower spray may be more suitable for distributing treating chemistry whereas the higher pressure spray may be more suitable for dislodging soils. The different spray patterns, including the differing directions of spray, created by the third embodiment may provide for different cleaning effects from the single spray arm 234. Although the lower rotatable spray arm 234 has been described as being similar to the first embodiment it is contemplated that the profile and gear assembly 284 of the spray arm 234 may alternatively be formed like that disclosed with respect to the second embodiment.

It will also be understood that depending upon the configuration of the outlets in the sprayer and the openings in the valve body that an outlet may be fluidly coupled with the liquid passage of the sprayer for a longer period of time than other outlets. This may be done in a variety of ways including, by having the outlet on the sprayer have two corresponding openings in the valve body that may fluidly couple the outlet as the valve body moves within the sprayer. Alternatively, the outlet may have a larger corresponding opening on the valve body, which may continue to fluidly couple the outlet and the larger opening as the valve body moves within the sprayer. Either example, would allow key outlets to be on greater lengths of time without having other non-key outlets on. Further, this may also aid in creating pressure differences in the spray exiting the outlets. Such pressure differences are set forth in detail in the application bearing Ser. No. 13/570,361 filed concurrently herewith, and titled "Dishwasher with Spray System," which is incorporated herein by reference in its entirety.

The remaining figures illustrate several exemplary sprayers with at least one liquid passage, a first outlet extending to an exterior of the sprayer and in fluid communication with the liquid passage. The sprayers each include a valve body having a first opening in fluid communication with the liquid passage. A fluid coupling selectively provides fluid communication between the first opening and the first outlet to provide for the passage of liquid from the liquid passage to the first outlet. The valve body and the sprayer are coupled for relative movement and the fluid coupling is configured such that the duration of the fluid communication between the first opening and first outlet is greater than the time it takes for another outlet and another opening of the same size to transit each other during the relative movement, as shown in the previous examples above.

Figure 7A:
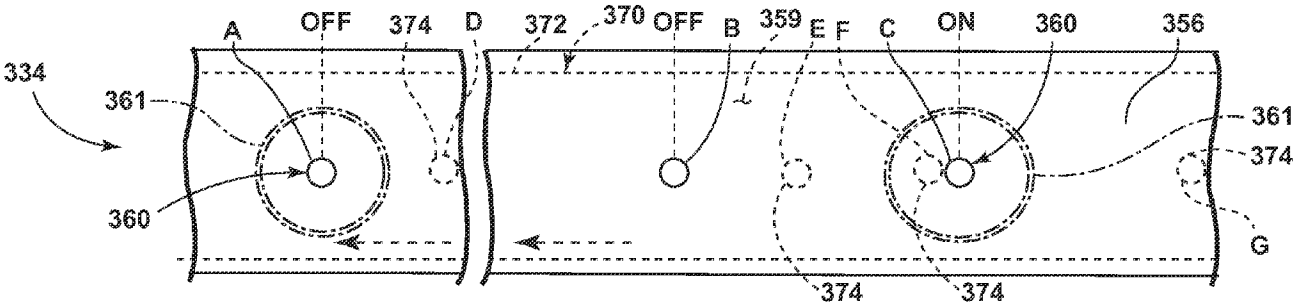
FIGS. 7A-7C are schematic top views of a valve body in various positions within a rotatable spray arm according to a fourth embodiment, which may be used in the dishwasher of FIG. 1.

FIG. 7A illustrates a portion of an alternative lower rotatable spray arm 334 and a valve body 370 according to a fourth embodiment of the invention. The lower rotatable spray arm 334 and valve body 370 are similar to the lower rotatable spray arm 34 and valve body 70 previously described and therefore, like parts will be identified with like numerals increased by 300, with it being understood that the description of the like parts applies to the fourth embodiment, unless otherwise noted.

One difference between the lower rotatable spray arm 34 and the lower rotatable spray arm 334 is that the lower rotatable spray arm 334, along with the valve body 370, is configured such that the duration of the fluid communication between a first opening and first outlet is greater than the time it takes for an outlet and an opening of the same size to transit each other during the relative movement. In the illustrated example, the lower rotatable spray arm 334 includes a plurality of nozzles or outlets 360, which have been denoted further with letters ranging from A-C and extend through the body 356 of the lower rotatable spray arm 334. Each of the outlets 360 may be in fluid communication with a liquid passage 359 of the lower rotatable spray arm 334. More specifically, the outlets 360 may be fluidly coupled with the liquid passage 359 within the lower rotatable spray arm 334 through movement of the valve body 370 similar to the embodiments described above. Although not illustrated, each of the outlets 360 may have a corresponding nozzle provided on the body 356.

It should be noted that the outlets 360 may be spaced in any variety of suitable manners along the lower rotatable spray arm 334 including that the outlets 360 may be offset from each other. In the illustrated example, a sealing ring 361 is included along an inner portion of the body 356 around two of the outlets 360. Such a sealing ring 361 may allow an opening 374 in the valve body 370 to fluidly couple with the outlet 360 so long as the opening 374 is at least partially within the sealing ring 361. In this manner, the sealing ring 361 creates a larger effective outlet and allows for a longer fluid communication between the outlet 360 having the sealing ring 361 and the opening 374 in the valve body 370. The sealing ring 361 may take any suitable form including that of an O-ring or other seal. The valve body 370 may be capable of sealing against the body 356 and the sealing rings 361 to better seal the outlets 360 against the unintended flow of liquid from the liquid passage 359. It is also contemplated that alternatively, the sealing ring could be included on the valve body 370 around an opening 374 and that this may also allow the opening 374 to fluidly couple with the outlet 360 so long as the outlet 360 is at least partially within the sealing ring surrounding the opening 374.

The outlets 360 have all been shown as being identical except that outlets A and C include a sealing ring 361 allowing outlets A and C to be coupled to the liquid passage 359 for a longer time. Outlet B does not include a sealing ring and therefore may only be fluidly coupled to the liquid passage 359 during the time it takes for the outlet B and its corresponding opening E, to transit each other during the relative movement of the body 356 and the valve body 370.

It is contemplated that the outlets 360 may be configured to provide for the same or different spray patterns as described in the above embodiments.

Another difference is that the slidable plate 372 of the valve body 370 has a different number of corresponding openings 374 for each of the illustrated outlets 360. In the illustrated example, the outlet A has a corresponding opening D, the outlet B has a corresponding opening E, and the outlet C has two corresponding openings F and G. The slidable plate 372 may be slidably mounted within the interior of the rotatable spray arm 334 for movement between multiple positions. The outlets 360 of the rotatable spray arm 334 and the openings 374 of the valve body 370 may be spaced and located in any suitable manner to create any variety of sprays, patterns, and pressures of sprays as the valve body 370 moves through its various positions and to increase or decrease the duration of the fluid communication between an opening 374 and an outlet 360.

Figure 7B:
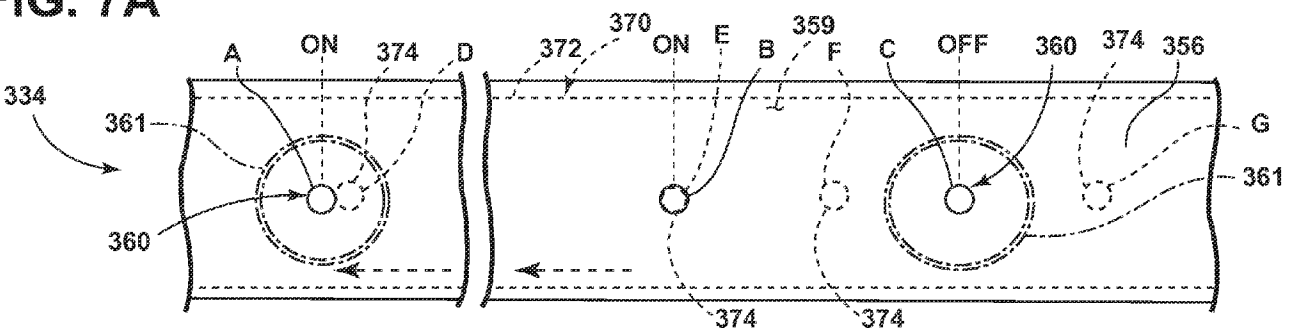
Figure 7C:
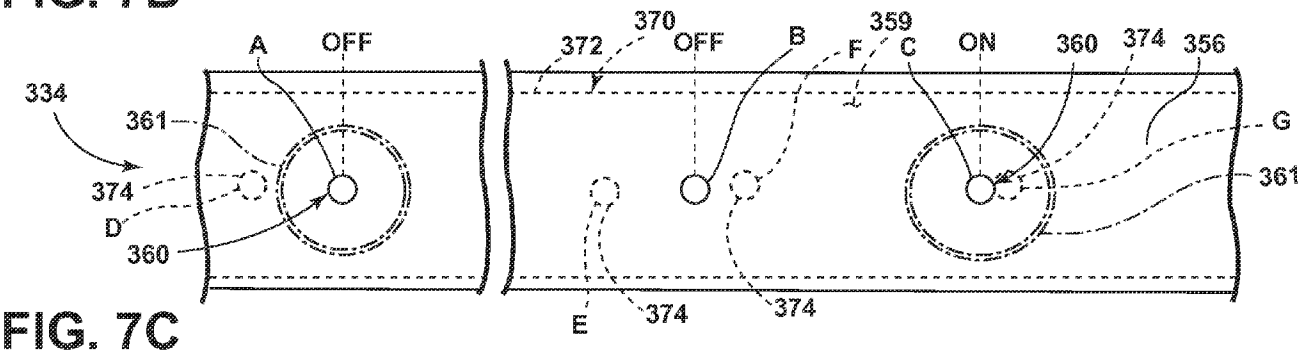

FIG. 7A illustrates the outlets 360 that may be open to the interior of the exemplary rotatable spray arm 334 when the exemplary valve body 370 is in a first position, FIG. 7B illustrates the outlets 360 that may be open to the interior of the rotatable spray arm 334 when the valve body 370 is in a second position, and FIG. 7C illustrates the outlets 360 that may be open to the interior of the rotatable spray arm 334 when the valve body 370 is in a third position. During operation, the lower rotatable spray arm 334, valve body 370, and actuator (not shown) operate much the same as in the first embodiment wherein as the lower rotatable spray arm 334 is rotated, gears in the gear assembly (not shown) are driven and the valve body 370 is moved between the first, second, and third positions. Alternatively, a gear assembly similar to that of the second embodiment may be used to achieve a higher gear reduction and longer dwell time. Further still, any suitable gear assembly or actuator may be used to move the valve body 370.

Beginning with the valve body 370 in the first position, illustrated in FIG. 7A, one of the two openings 374 in the valve body 370 associated with outlet C align within the sealing ring 361 surrounding outlet C. The outlet C has been denoted with the identifier "ON" because in this position the opening F aligns with the sealing ring 361 to allow liquid to spray out of the outlet C. In this manner, a fluid coupling is included in the lower rotatable spray arm 334 and selectively provides fluid communication between the opening F and the outlet C to provide for the passage of liquid from the liquid passage 359 to the outlet C.

The valve body 370 is moved in the direction of the arrows and as the valve body 370 is moved to the second position as illustrated in FIG. 7B, the outlet C is no longer fluidly coupled to the interior of the lower rotatable spray arm 334. Instead outlets A and B are turned on. More specifically, the opening D aligns within the sealing ring 361 of the outlet A and the opening E aligns with the outlet B. It will be understood that opening E and outlet B are the same size and that the outlet B has been illustrated slightly larger than the opening E merely for clarity in the illustration.

When the valve body 370 moves to the third position, illustrated in FIG. 7C, the other of the two openings 374 in the valve body 370 associated with outlet C align within the sealing ring 361 surrounding outlet C. More specifically, outlet C turns "ON" because in this positionb the opening G aligns with the sealing ring 361 to allow liquid to spray out of the outlet C. While the actual time or amount of revolutions that the liquid is sprayed from each of the outlets 360 may be altered based on the design of the lower rotatable spray arm 334, valve body 370, etc. it will be understood that in the above illustrated example, the fluid coupling is configured such that the duration of the fluid communication between the outlet C and the opening F combined with the fluid communication between outlet C and opening and G is greater than the time it takes for an outlet and an opening of the same size, such as the outlet B and the opening E, to transit each other during the relative movement. For example, outlet A and outlet C are on longer than outlet B because they both have a sealing ring 361 to increase the area at which the outlet 360 may fluidly couple with the openings 374 in the valve body 370. Further, outlet C is on much longer than outlet B because it has two corresponding openings 374 in the valve body 370, which may allow for fluid coupling of the outlet C with the interior of the lower rotatable spray arm 334. It is also contemplated that the outlets may not include sealing rings 361, in such an instance outlet C would still have an increased on time because it has two openings in the valve body 370 that may provide for fluid coupling with the liquid passage 359 of the lower rotatable spray arm 334. It will be understood that outlet B and opening E need not actually be included on the lower rotatable spray arm 334 but that they have been shown to illustrate the difference in the fluid coupling times of the various outlets 360 and openings 374.

Figure 8A:
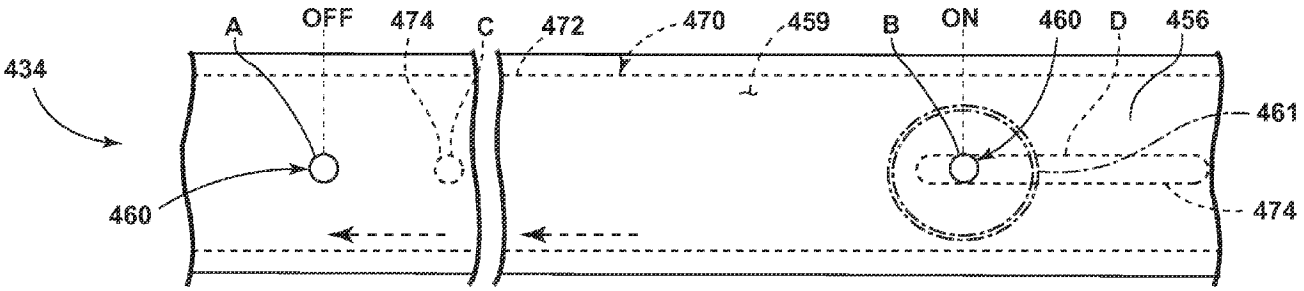
FIGS. 8A-8C are schematic top views of a valve body in various positions within a rotatable spray arm according to a fifth embodiment, which may be used in the dishwasher of FIG. 1.
Figure 8B:
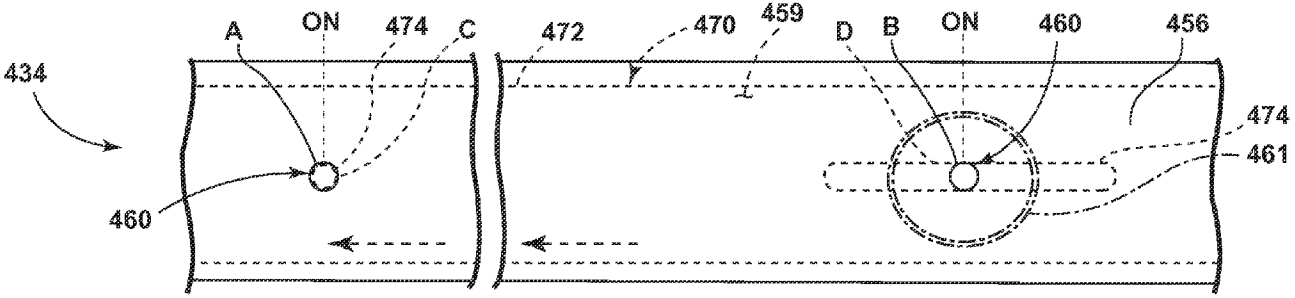
Figure 8C:
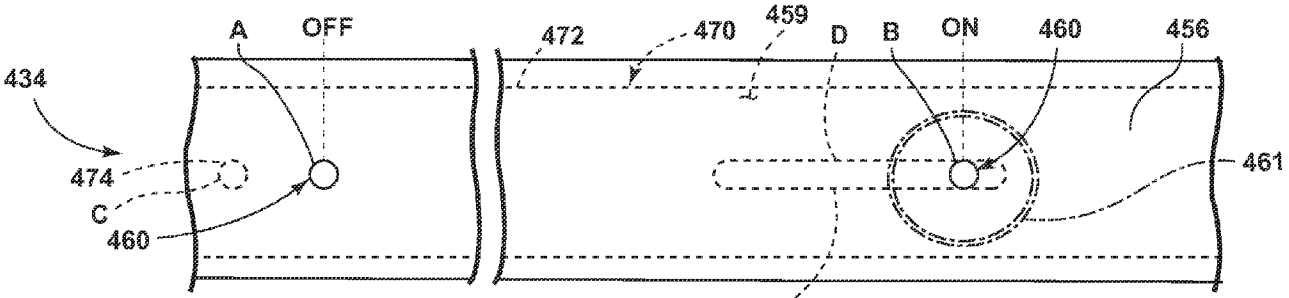

FIGS. 8A-8C illustrate portions of an alternative lower rotatable spray arm 434 and a valve body 470 according to a fifth embodiment of the invention. The lower rotatable spray arm 434 and valve body 470 are similar to the lower rotatable spray arm 334 and valve body 370 previously described and therefore, like parts will be identified with like numerals increased by 100, with it being understood that the description of the like parts applies to the fifth embodiment, unless otherwise noted.

One difference between the lower rotatable spray arm 334 and the lower rotatable spray arm 434 is that the lower rotatable spray arm 334, includes a plurality of nozzles or outlets 460, which have been denoted further with letters ranging from A-B and extend through the body 456 of the lower rotatable spray arm 434. It should be noted that the outlets 460 may be spaced in any variety of suitable manners along the lower rotatable spray arm 434 including that the outlets 460 may be offset from each other. In the illustrated example, a sealing ring 461 is included along an inner portion of the body 456 around the outlet B. Such a sealing ring 461 may allow an opening 474 in the valve body 470 to fluidly couple with the outlet 460 so long as the opening 474 is at least partially within the sealing ring 461. In this manner, the sealing ring 461 creates a larger effective outlet and allows for a longer fluid communication between the outlet 460 having the sealing ring 461 and the opening 474 in the valve body 470. The sealing ring 461 may take any suitable form including that of an O-ring or other seal. The valve body 470 may be capable of sealing against the body 456 and the sealing rings 461 to better seal the outlets 460 against the unintended flow of liquid from the liquid passage of the lower rotatable spray arm 434. It is also contemplated that alternatively, the sealing ring could be included on the valve body 470 around an opening 474 and that this may also allow the opening 474 to fluidly couple with the outlet 460 so long as the outlet 460 is at least partially within the sealing ring surrounding the opening 474.

Another difference is that each outlet 460 only includes one corresponding opening 474 in the slidable plate 472 of the valve body 470. In the illustrated example, the outlet A has a corresponding opening C, which is identical in size to the outlet A. It will be understood that opening C and outlet A are the same size and that the outlet B has been illustrated slightly larger than the opening C merely for clarity in the illustration. Alternatively, the opening C and outlet A may be different sizes. The outlet B also has a corresponding opening D, which is shaped differently from the outlet B. More specifically the opening D is very long such that as the slidable plate 472 moves between multiple positions at least a portion of the opening D allows for fluid communication with the interior of the lower rotatable spray arm 434. In this manner, there is a fluid coupling providing fluid communication between the opening D and the outlet B during all three illustrated positions in FIGS. 8A-8C. Outlet B would be fluidly coupled with the interior of the lower rotatable spray arm 434 through opening D regardless of the inclusion of the sealing ring 461 around the outlet B. With outlet A and opening C there is only a fluid coupling providing fluid communication between the opening C and the outlet A during the second illustrated position in FIG. 8B. It will be understood that any variety of outlets 460 and openings 474 may be included in the lower rotatable spray arm 434 and that outlet B and opening E need not actually be included on the lower rotatable spray arm 434 but that they have been shown to illustrate the difference in the fluid coupling times of the various outlets 460 and openings 474.

Figure 9A:
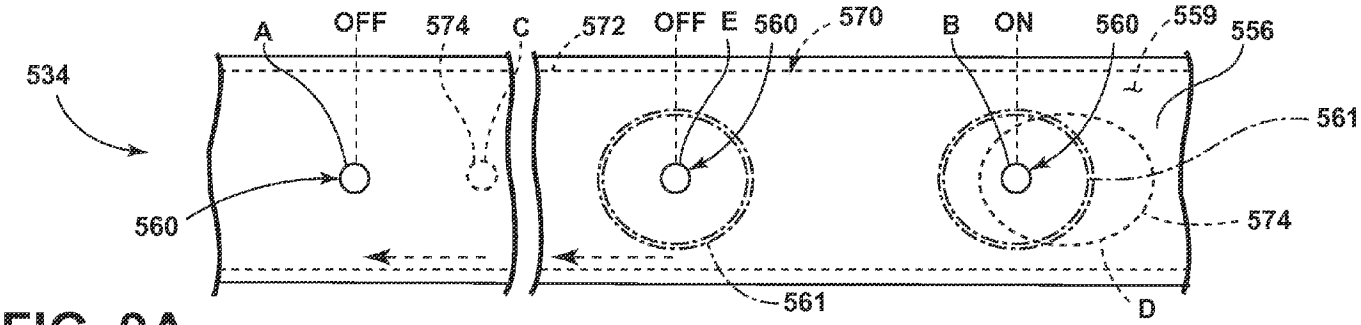
FIGS. 9A-9C are schematic top views of a valve body in various positions within a rotatable spray arm according to a sixth embodiment, which may be used in the dishwasher of FIG. 1.
Figure 9B:
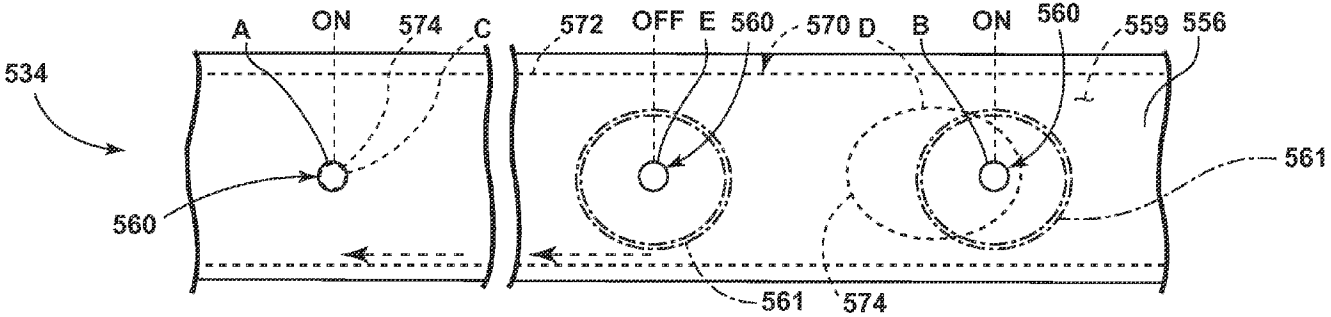
Figure 9C:
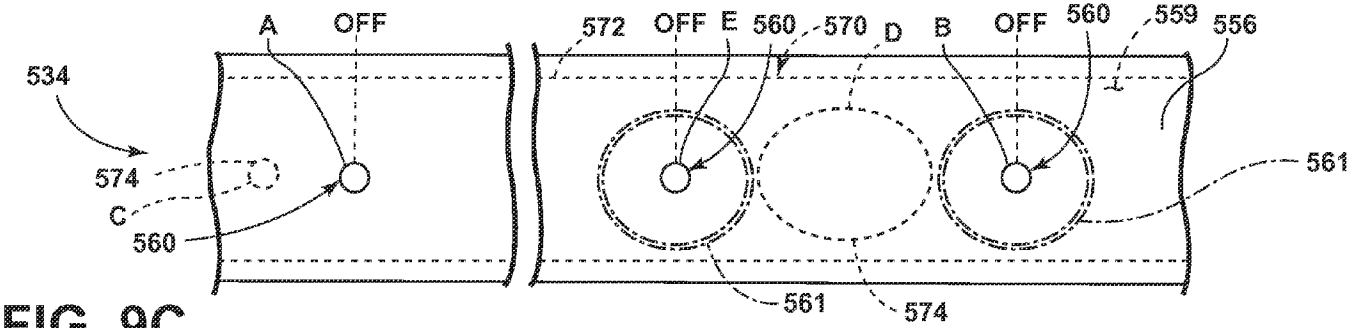

FIGS. 9A-9C illustrate portions of an alternative lower rotatable spray arm 534 and a valve body 570 according to a sixth embodiment of the invention. The lower rotatable spray arm 534 and valve body 570 are similar to the lower rotatable spray arm 434 and valve body 470 previously described and therefore, like parts will be identified with like numerals increased by 100, with it being understood that the description of the like parts applies to the sixth embodiment, unless otherwise noted.

One difference between the lower rotatable spray arm 434 and the lower rotatable spray arm 534 is that the opening 574 associated with the outlet B, which is denoted as opening D is larger in cross-sectional area. The opening D may be any size including that it may be at least twice the size of the outlet B. Not only does the opening D have a larger cross-sectional area than the outlet B it also has a larger cross-sectional area than the effective outlet formed by the sealing ring 561 around the outlet B. There is a fluid coupling providing fluid communication between the opening D and the outlet B during two of the three illustrated positions in FIGS. 9A-9C. Notably, outlet B would be fluidly coupled with the interior of the lower rotatable spray arm 534 through opening D regardless of the inclusion of the sealing ring 561 around the outlet B in the first two positions. With outlet A and opening C there is only a fluid coupling providing fluid communication between the opening C and the outlet A during the second illustrated position in FIG. 9B.

Another difference is that an outlet 560 is spaced from the outlet B and is denoted as outlet E. The opening D has a first portion, in this case a length that is less than an edge to edge spacing of the outlets B and E. As the valve body 570 moves along a predetermined path that passes over the outlets B and E. The relative size of the opening D and the edge to edge spacing of the outlets B and E is such that the opening D is at least temporarily not fluidly coupled to either of the two outlets B and E as the valve body 570 moves along the predetermined path. Alternatively, the opening D may have a length that is greater than an edge to edge spacing of the at least two outlets B and E and may fluidly couple both of the outlets B and E to the interior of the lower rotatable spray arm 543 simultaneously. This may be achieved by either lengthening the size of the opening D or decrease ding the edge to edge spacing of the outlets B and E. More specifically, the relative size of the first portion and the edge to edge spacing may be made such that the opening is at least temporarily fluidly coupled to both of the at least two outlets as the valve body moves along the predetermined path.

There are several advantages of the present disclosure arising from the various features of the apparatuses described herein. For example, the embodiments described above allow for additional coverage of the treating chamber 20 with multiple spray patterns. The first and second embodiments allow for multiple types of spray nozzles having multiple spray patterns, which may be used during a cycle of operation, which in turn may result in better cleaning of utensils within the treating chamber 20 with no additional liquid consumption. Further, because the lower rotatable sprayers have multiple subsets of outlets and each multiple subset has a smaller total nozzle area than current spray arm designs, lower flow rates may be used and this may result in less liquid or water being required. This may increase the velocity of the spray emitted from each of the first and second subsets of nozzles while not sacrificing coverage or individual nozzle size. Further, with less liquid flow needed, a smaller recirculation pump having a smaller motor may also be used which may result in a cost and energy savings. The third embodiment described above allows for a single type of nozzle which emits varying spray patterns, including sprays in different directions and having different intensities, which may result in additional coverage of the treating chamber 20 and better cleaning of utensils within the treating chamber 20 with no additional liquid consumption. The fourth, fifth, and sixth embodiments allow particular outlets to spray liquid for longer periods of time than other outlets.

While the invention has been specifically described in connection with certain specific embodiments thereof, it is to be understood that this is by way of illustration and not of limitation. For example, it has been contemplated that the valve body and actuator may be located in other rotatable spray arms such as a mid-level rotatable spray arm. Further, other actuators may be used to control the movement of the valve body based on the rotation of the lower rotatable spray arm and the illustrated actuators including gear assemblies are merely exemplary. Further, although both gear assemblies illustrated include the same number of gears, it has been contemplated that the gear assembly may include any number of gears. Further, even though the gear assemblies are shown in a stacked configuration they could organized in a more horizontal layout. Further, while the valve body has been illustrated and described as moving in a linear motion it is contemplated that the valve body may alternatively be moved in an orbital motion. Such a motion could be created in a variety of ways including, by way of non-limiting example, replacing the pin described above with a pivot pin, which is mounted to the valve body slightly off center of the final gear, which would allow the plate to orbit. Alternatively, one end of the valve body may have a pin in a short longitudinal slot defining one end, while the other end orbits. As yet another non-limiting alternative, an additional gear may be added in the same plane as the fourth gear and may be of the same size and thus rotate at a synchronized speed with the fourth gear. A pin may be included on this additional gear and may orbit in unison with and retain a constant distance from the other pin. Since the valve plate is engaged to both pins the entire plate would be caused to orbit. With the valve body, or a portion of the valve body, capable of orbital motion the multiple openings may be dispersed in a two-dimension plane in a wider variety of ways such that the outlets could be changed when the valve body orbits.

Further, the valve body could be made to orbit around the multiple openings to allow for sprays in all directions.

Further still, while the sprayer has been illustrated and described as a rotatable spray arm it will be understood that any suitable sprayer may be used. For example, a non-rotatable spray arm may be used and the actuator may move the valve body within the spray arm. Further, a sprayer having a different shape may be used and may be either rotatable or non-rotatable. Similarly, while the valve body has been described and illustrated as a slidable plate it is contemplated that the valve body may take any suitable form and that the slidable plate may take any suitable form. For example, the slidable plate may include a rigid plate, a flexible plate, or a thin film plate, which may be either flexible or rigid. Further, the valve body may include a moveable element and at least a portion may conform to the shape of the sprayer. Such a conformable valve body is set forth in detail in the application bearing applicant's Ser. No. 13/570,577, filed concurrently herewith, and titled "Dishwasher with Spray System," which is incorporated herein by reference in its entirety. Further, it will be understood that any features of the above described embodiments may be combined in any manner.

The patentable scope of the invention is defined by the claims, and may include other examples that occur to those skilled in the art. Reasonable variation and modification are possible within the scope of the forgoing disclosure and drawings without departing from the spirit of the invention which is defined in the appended claims.

What is claimed is:

1. A dishwasher for treating utensils according to an automatic cycle of operation, comprising:

a tub at least partially defining a treating chamber for receiving utensils for treatment according to the automatic cycle of operation;

a spraying system for supplying liquid to the treating chamber and having a sprayer with at least one liquid passage, a first outlet extending to an exterior of the sprayer and in fluid communication with the liquid passage;

a valve body having a first opening in fluid communication with the liquid passage;

a seal located between the first opening and the first outlet, the seal surrounding the first outlet and fluidly sealing the first outlet relative to the valve body, and wherein the seal creates an effective outlet for the first outlet, wherein the effective outlet is larger than the first outlet, and allows for a longer duration of the fluid communication between the first outlet and the first opening; and wherein the valve body and the sprayer are coupled for relative movement to each other and the first outlet and the first opening are differently sized, and one of the first outlet or the first opening defines a first size and the other of the first outlet or the first opening defines a second size that is larger than the first size, wherein when the valve body moves relative to the sprayer a duration of the fluid communication between the first opening and the first outlet is increased as compared to had the first outlet and the first opening both been the first size.

2. The dishwasher of claim 1, further comprising at least two spaced first outlets.

3. The dishwasher of claim 2 wherein the first opening has a first portion that is less than an edge to edge spacing between at least two adjacent spaced first outlets.

4. The dishwasher of claim 3 wherein the valve body moves along a predetermined path that passes over the at least two adjacent spaced first outlets.

5. The dishwasher of claim 4 wherein a relative size of the first portion and the edge to edge spacing is such that the first opening is at least temporarily not fluidly coupled to either of the at least two adjacent spaced first outlets as the valve body moves along the predetermined path.

6. The dishwasher of claim 2 wherein the first opening has a first portion that is greater than an edge to edge spacing of the at least two ad adjacent spaced first outlets.

7. The dishwasher of claim 6 wherein a relative size of the first portion and the edge to edge spacing is such that the first opening is at least temporarily fluidly coupled to both of the at least two adjacent first outlets as the valve body moves along a predetermined path.

8. A dishwasher for treating utensils according to an automatic cycle of operation, comprising:

a tub at least partially defining a treating chamber for receiving utensils for treatment according to the automatic cycle of operation;

a spraying system for supplying liquid to the treating chamber and having a sprayer with at least one liquid passage, a first outlet extending to an exterior of the sprayer and in fluid communication with the liquid passage;

a valve body having a first opening in fluid communication with the liquid passage configured to reciprocally move with respect to the sprayer; and a sealing ring located between the first outlet and the first opening, the sealing ring surrounding one of the first outlet or the first opening and fluidly sealing the valve body to the sprayer and defining an effective cross-section outlet area larger than the first outlet or the first opening; and wherein the valve body reciprocally moves with respect to the sprayer to selectively fluidly couple the first opening and the first outlet and wherein the sealing ring is configured to allow the first opening or the first outlet to have the effective cross-sectional area to increase a duration of the fluid communication between the first opening and the first outlet as the valve body moves within the sprayer.

9. The dishwasher of claim 8 wherein the sealing ring includes a second opening fluidly coupling the first opening and the first outlet, and wherein the second opening defines a length dimension parallel with the reciprocal movement of the valve body, and wherein the length dimension is larger than the one of the first outlet or the first opening.

10. The dishwasher of claim 9 wherein the seal is configured to create a seal between the valve body and the sprayer.

11. The dishwasher of claim 9 wherein the sprayer defines an interior in which the liquid passage is provided, with the first outlet extending from the exterior to the interior.

12. The dishwasher of claim 11 wherein the valve body comprises a moveable element located within the interior and having a portion conforming to a shape of the sprayer.

13. The dishwasher of claim 12 wherein the sprayer comprises a rotating spray arm.

14. The dishwasher of claim 13 wherein the valve body comprises a plate.

15. The dishwasher of claim 14 wherein the plate is reciprocally moveable within the interior.

16. The dishwasher of claim 9 wherein the valve body further comprises a second opening in fluid communication with the liquid passage.

17. A dishwasher for treating utensils according to an automatic cycle of operation, comprising:

a tub at least partially defining a treating chamber for receiving utensils for treatment according to the automatic cycle of operation;

a spraying system for supplying liquid to the treating chamber and having a sprayer with at least one liquid passage, a first outlet extending to an exterior of the sprayer and in fluid communication with the liquid passage;

a valve body having a first opening in fluid communication with the liquid passage and configured for movement with respect to the sprayer; and a fluid coupling selectively providing fluid communication between the first opening and the first outlet to provide for a passage of liquid from the liquid passage to the first outlet and wherein the fluid coupling comprises a seal located between the first opening and the first outlet, the seal surrounding the first outlet and fluidly sealing the first outlet relative to the valve body, and wherein the seal is configured to create an effective outlet for the first outlet, wherein the effective outlet is larger than the first outlet, and that allows for a longer duration of the fluid communication between the first outlet and the first opening as the valve body moves with respect to the sprayer.

* * * * *